US006457269B1

(12) United States Patent
Esterhuyse et al.

(10) Patent No.: US 6,457,269 B1
(45) Date of Patent: Oct. 1, 2002

(54) GROUND-ENGAGING TOOL FOR AN EXCAVATION BUCKET

(75) Inventors: Schalk Willem Petrus Esterhuyse, Pretoria; Louw Kriel, Boksburg North, both of (ZA)

(73) Assignee: Caterpillar Sarl, Geneva (CH)

( * ) Notice: Subject to any disclaimer, the term of this patent is extended or adjusted under 35 U.S.C. 154(b) by 0 days.

(21) Appl. No.: 09/594,076

(22) Filed: Jun. 14, 2000

(51) Int. Cl.[7] ..... E02F 3/00

(52) U.S. Cl. ..... 37/460; 172/747; 172/713; 172/753; 37/452

(58) Field of Search ..... 37/460, 452, 446; 299/111, 112; 172/747, 713, 753

(56) References Cited

U.S. PATENT DOCUMENTS 3,622,206 A * 11/1971 Krekeler
3,984,910 A * 10/1976 Helton et al.
5,081,774 A * 1/1992 Kuwano
5,210,965 A * 5/1993 Funk, Sr. et al.
5,375,350 A * 12/1994 Maybon
5,392,870 A * 2/1995 Clapham et al.

OTHER PUBLICATIONS

Manufacturing Processes by Roberts and Lapidge, p. 1 and 2 (1977).*

* cited by examiner

*Primary Examiner*—Victor Batson
(74) *Attorney, Agent, or Firm*—Kilpatrick Stockton LLP

(57) ABSTRACT

The invention relates to a ground-engaging tool which is connected or connectable to a lip on an excavation bucket. The ground-engaging tool includes a tool body which is formed from a material having a hardness of approximately 40 Rockwell C hardness and which defines a contact surface at one end for receiving impacts in use. Extending through a substantial portion of the tool body from the contact surface is a hardened core formed from a material having a hardness which is at least 20% greater than the hardness of the material of the tool body for transferring impacts through the tool body.

10 Claims, 2 Drawing Sheets

GROUND-ENGAGING TOOL FOR AN EXCAVATION BUCKET

BACKGROUND OF THE INVENTION

This invention relates to a ground-engaging tool, and more specifically to a ground-engaging tooth for an excavation bucket.

Conventional ground-engaging teeth for excavation buckets generally are designed to be replaced when worn. In some of the known arrangements, the teeth comprise one-piece tips which are welded to a lip on the bucket and which have to be cut off the lip when replaced. In other arrangements, each tooth includes an adaptor which is either releasably attachable to a nosepiece on a bucket lip or is welded directly to the bucket lip, and a tip which is releasably attachable to the adaptor, typically with a locking pin. This type of tooth is replaced by removing the locking pin and sliding the tip off the adaptor.

In certain applications, for example dragline operations, the tips are exposed to excessive abrasion and tend to wear down relatively quickly so that it is necessary to replace these tips fairly often. Since replacement of the ground-engaging teeth interrupts the dragline operation, it is desirable to have relatively durable teeth which do not require frequent replacement.

For the purpose of this specification, the term "excavate" includes the operation of a dragline, and accordingly reference to an "excavation bucket" should be understood to include a dragline bucket.

SUMMARY OF THE INVENTION

According to the invention there is provided a ground-engaging tool which is connected or connectable to a lip on an excavation bucket, the ground-engaging tool comprising:

- a tool body which is formed from a material having a hardness greater than or equal to 35 Rockwell C hardness and which defines a contact surface at one end for receiving impacts; and
- a hardened core extending through at least a substantial portion of the tool body from the contact surface or a region approximate the contact surface for transferring impacts through the tool body, the hardened core being formed from a material having a hardness which is at least 20% greater than the hardness of the material of the tool body.

Typically, the contact surface is sized so as to present a blunt edge at one end of the tool body.

In a preferred embodiment of the invention, the hardened core is in the form, of a cylinder and the longitudinal axis of the core is offset relative to the longitudinal axis of the tool body.

In a particularly preferred embodiment, the tool body is formed from a steel which has a yield strength of approximately 700 MPa and which is heat treated to a hardness of approximately 40 Rockwell C hardness, and the hardened core is formed from a Tungsten Carbide having a hardness of approximately 83.5 Rockwell A hardness.

The tool body may be machined and the core may be press fitted into a pre-formed hole in the tool body. In this case, an adhesive may be applied to the core prior to insertion into the tool body.

Alternatively, the ground-engaging tool may be formed in a casting process.

In one arrangement, the tool body is designed to be welded to the lip of the excavation bucket.

In another arrangement, the tool body includes a formation which is releasably connectable to an adaptor on the lip of the excavation bucket.

Typically, the tool body tapers inwardly towards the contact surface.

BRIEF DESCRIPTION OF THE DRAWINGS

The invention will now be described in more detail, by way of example only, with reference to the accompanying drawings in which.

DESCRIPTION OF AN EMBODIMENT

Figure 1:
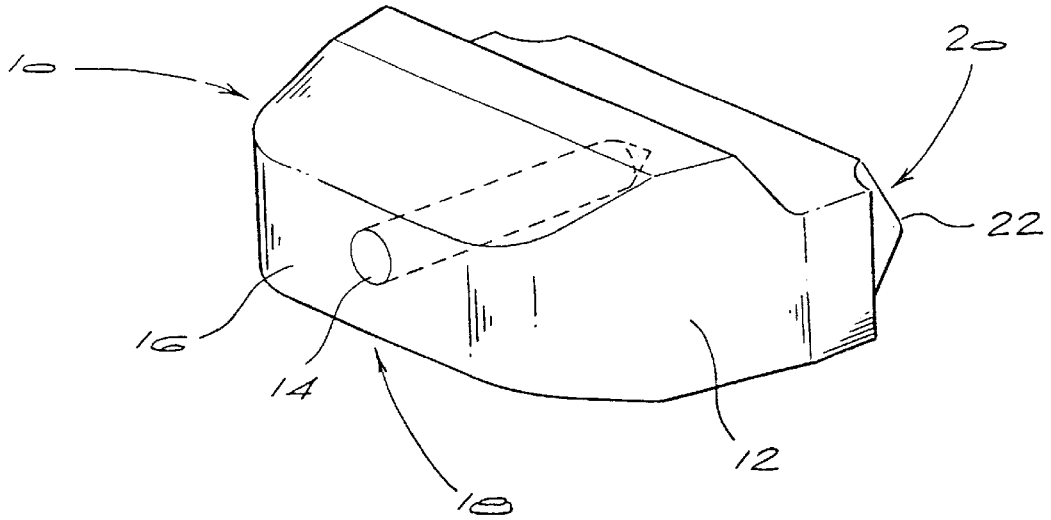
FIG. 1 shows a perspective view of a ground-engaging tool according to the present invention.
Figure 2:
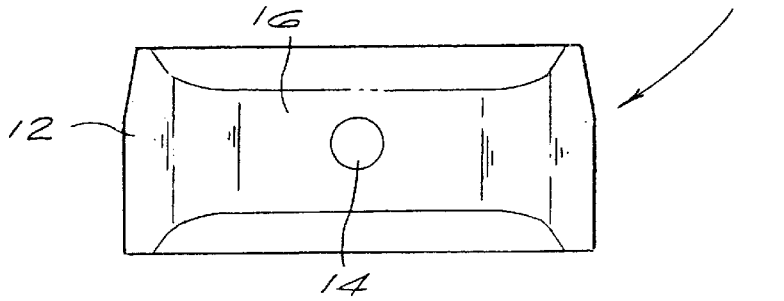
FIG. 2 shows a front view of the ground-engaging tool illustrated in FIG. 1.
Figure 3:
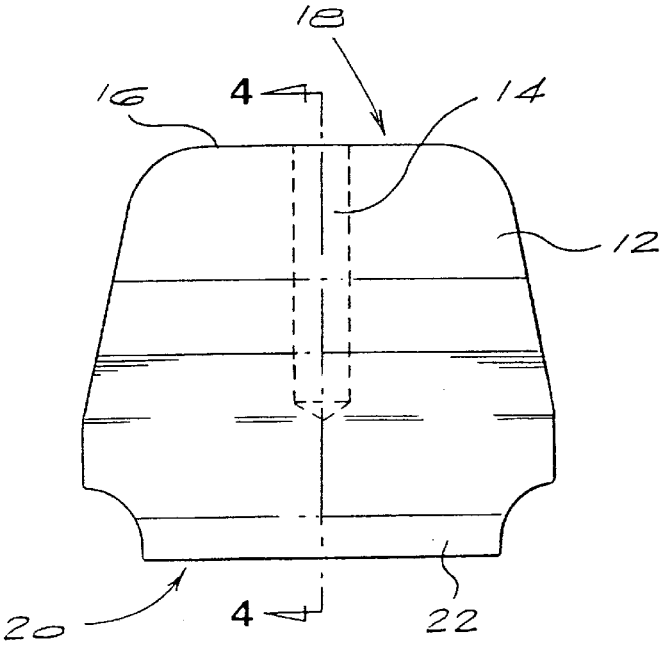
FIG. 3 shows a top view of the ground-engaging tool illustrated in FIG. 1.
Figure 4:
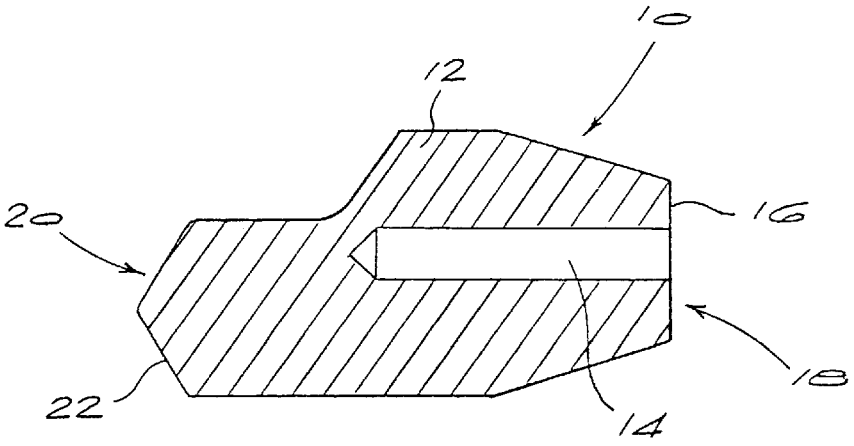
FIG. 4 shows a cross-sectional view along the line 44 in FIG. 3.

A ground-engaging tool according to the present invention is illustrated in various views in FIGS. 1 to 4 of the accompanying drawings. The tool is designated generally with the reference numeral 10 and includes a tool body 12 and a hardened core 14 which extends through a substantial portion of the tool body.

As can be seen, the tool body 12 defines a contact surface 16 at one end 18 thereof for engaging material to be excavated in use. The contact surface is sized to present a blunt edge at the end 18, as shown, and the tool body 12 is seen to taper inwardly towards this blunt edge. At an opposite end 20 of the tool body there is a formation 22 which facilitates the welding of the tool 10 to a lip (not shown) on a dragline bucket (also not shown).

In this embodiment of the invention, the core 14 is in the form of a cylinder which extends from the contact surface 16 towards the formation 22. The core 14 is positioned so that the exposed tip of this core is located at a region on the contact surface 16 at which the highest impact loads occur in use. In tests conducted by the applicant, it has been found that the region of highest impact loading is offset relative to the longitudinal axis of the tool body 12 and accordingly the core 14 is arranged so that its longitudinal axis is suitably offset relative to the longitudinal axis of the tool body.

In practice, the tool body 12 is machined from a steel having a yield strength of 700 MPa, typically WELDOX™ 700 steel, and is subsequently heat treated to a hardness of approximately 40 Rockwell C hardness. The core 14 is formed from a Tungsten Carbide having a hardness of approximately 83.5 Rockwell A hardness and is press fitted into a pre-formed hole in the tool body 12. If desired, an adhesive may be applied to the outer surface of the core 14 immediately prior to inserting the core into the tool body.

Figure 5:
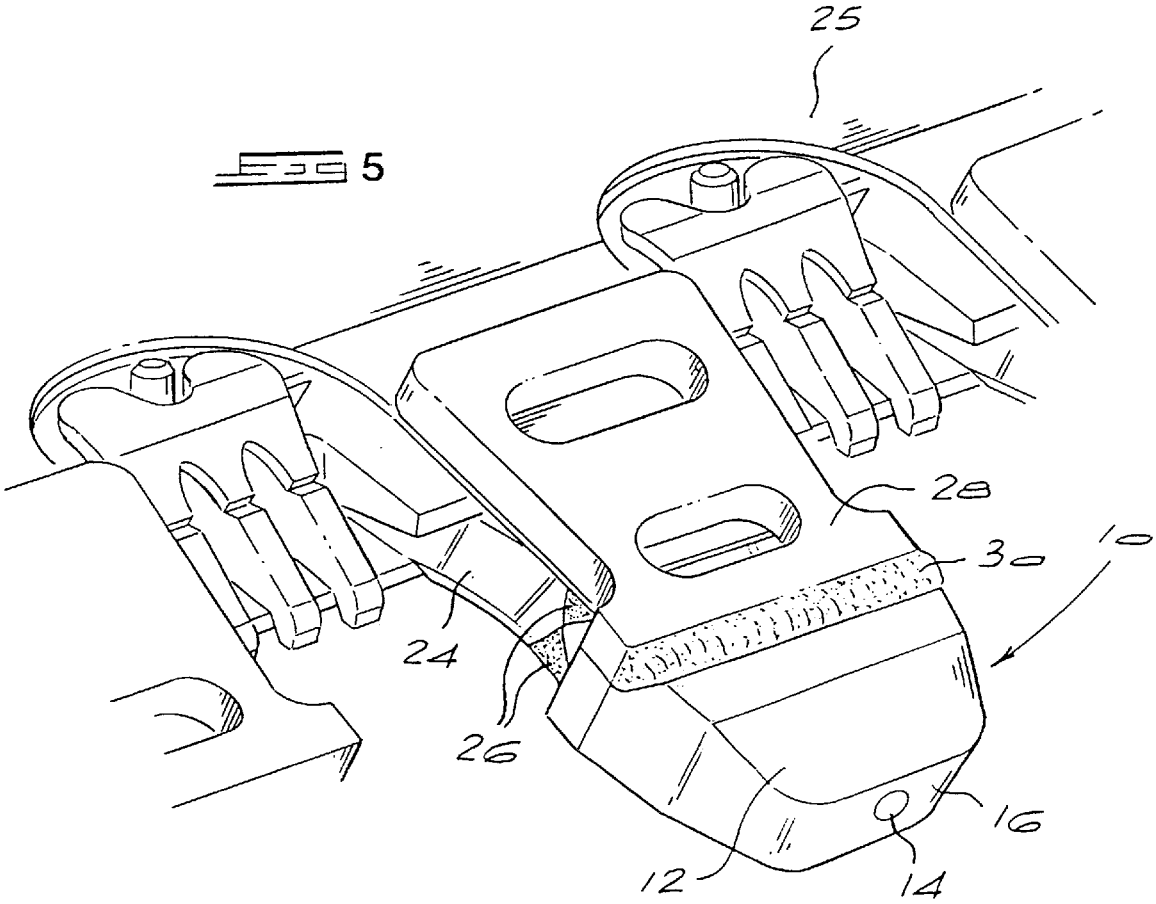
FIG. 5 shows a perspective view of the ground-engaging tool of the invention welded to a lip on a dragline bucket.

With reference now to FIG. 5 of the accompanying drawings, the ground-engaging tool 10 is welded to a lip 24 on a dragline bucket 25 with butt welds 26. A protector plate 28 is then welded to the lip 24 with welds (not shown) and to the tool 10 with a but weld 30. Typically, eight ground-engaging tools 10 are welded to the lip 24 at spaced-apart locations along the length of the lip to form a plurality of ground-engaging teeth on the bucket 25.

In use, as the dragline bucket is dragged through material to be excavated, the contact surface 16 of each tooth receives impact loads which are transferred to the lip of the bucket through the tool body 12. Since the core 14 has a higher hardness than the rest of the tool 10, the portions of the tool body 12 around the core initially wear down at a faster rate than the core, and this results in the sharpening of the free end of the tooth. However, as the tool body 12 around the core 14 wears away and the tip of the core becomes more and more exposed, the core receives a greater proportion of the impact loads and thereby retards the wear on the toot body. The increase in the impact loading of the core 14 eventually results in the breaking away of the exposed tip of the core and the wear pattern is then repeated. When the tool 10 is fully worn, it is cut off the lip and replaced.

It has been found that the presence of the core 14 which results in the wear pattern described above serves to increase the wear life of the tool 10 substantially.

In another, non-illustrated embodiment of the invention, the ground-engaging tool includes a formation which is releasably connectable to an adaptor on a lip of a dragline bucket.

Although the invention has been described above with reference to a machined tool body, it should be appreciated that the ground-engaging tool could also be formed in a casting process.

We claim:

1. A ground-engaging tool for an excavation bucket, the ground-engaging tool comprising:

an outer wear element in the form of a tool body formed from a material having a hardness greater than or equal to 35 Rockwell C hardness, the tool body defining a contact surface at one end for receiving impacts, a longitudinal axis extending rearwardly from the contact surface, and at least one operatively upper surface; and an inner wear element in the form of a hardened wear-retarding core which extends rearwardly from the contact surface or a region approximate the contact surface for transferring impacts through the tool body, the hardened core being formed from a material having a hardness which is at least 20% greater than the hardness of the material of the tool body and defining a longitudinal axis which extends substantially parallel to the longitudinal axis of the tool body and which lies between the at least one operatively upper surface and the longitudinal axis of the tool body.

2. A ground-engaging tool according to claim 1, wherein the contact surface is sized so as to present a blunt edge at one end of the tool body.

3. A ground-engaging tool according to claim 1, wherein the hardened core is in the form of a cylinder.

4. A ground-engaging tool according to claim 1, wherein the tool body is formed from a steel which has a yield strength of approximately 700 MPa and which is heat to a hardness of approximately 40 Rockwell C hardness, and the hardened core is formed from a tungsten carbide having a hardness of approximately 83.5 Rockwell A hardness.

5. A ground-engaging tool according to claim 1, wherein the tool body is machined and the core is press fitted into a pre-formed hole in the tool body.

6. A ground-engaging tool according to claim 5, wherein an adhesive is applied to the core prior to insertion into the tool body.

7. A ground-engaging tool according to claim 1, which is formed in a casting process.

8. A ground-engaging tool according to claim 1, wherein the tool body is designed to be welded to the lip of the excavation bucket.

9. A ground-engaging tool according to claim 1, wherein the tool body includes a formation which is releasably connectable to an adaptor on the lip of the excavation bucket.

10. A ground-engaging tool according to claim 1, wherein the tool body tapers inwardly towards the contact surface.

* * * * *